United States Patent [19]

Hendrischk et al.

[11] 4,024,940

[45] May 24, 1977

[54] MATRIX PRINTER HAVING DOCUMENT THICKNESS COMPENSATING DEVICE

[75] Inventors: Wolfgang Hendrischk, Neu-Ulm; Hubert Ott; Wolfgang Seybold, both of Ulm; Horst Heisele, Asselfingen; Karl Mayr, Niederstotzingen, all of Germany

[73] Assignee: Mannesmann Aktiengesellschaft, Dusseldorf, Germany

[22] Filed: Apr. 13, 1976

[21] Appl. No.: 676,482

[52] U.S. Cl. ..... 197/1 R; 197/149

[51] Int. Cl.[2] ..... B41J 3/50; B41J 3/04

[58] Field of Search ..... 197/1 R, 149; 101/93.03, 93.04, 93.05

[56] References Cited

UNITED STATES PATENTS 3,750,792 8/1973 Liles ..... 197/1 R

FOREIGN PATENTS OR APPLICATIONS 2,318,947 10/1974 Germany ..... 197/1 R 2,248,262 11/1974 Germany ..... 197/1 R

OTHER PUBLICATIONS

Frechette, Kenneth R.; Automatic Impression Control, Xerox Disclosure Journal, vol. 1, No. 7, July 1976, p. 31.

*Primary Examiner*—Clifford D. Crowder

*Attorney, Agent, or Firm*—Ralf H. Siegemund

[57] ABSTRACT

A matrix printer with a reciprocating carriage carries transversely moving spring biased printing head. A roller on the head runs on a resilient rail urged against the platen and can be retracted by pivoting the rail carrier under engagement of a second rail cooperating with a second roller on the head. A cam track in a terminal position of the carriage provides for independent head retraction through engagement with the second roller.

6 Claims, 4 Drawing Figures

1
2
3
4
5
6
7
8
9
10
10
11
12
13
14
15
16
17
18
19
20
21
22
23
24
29
31
32
37

MATRIX PRINTER HAVING DOCUMENT THICKNESS COMPENSATING DEVICE

BACKGROUND OF THE INVENTION

The present invention relates to a matrix printer with a back and forth movable carriage on which is mounted a printing head which, in turn, is movable aganst the force of a spring in a direction transverse to the direction of movement of the carriage.

The printer head of a matrix printer is usually equipped with a plurality of printing needles whose front end or tips are arranged in a vertical column or in a staggered relationship. The rear ends of the needles are provided with electromagnetic drives whose activation causes the particular printing needle to be propelled forward. Since the lifting stroke of such a needle is very small, it is necessary to guide the head across the sheet to be printed on in rather accurate fashion. The British Pat. No. 894,276 describes a printing head in which the head as well as the ink ribbon slide across the paper. However, the matrix printers as they are known today have, for example, a roller at the printer head which rolls on the sheet of paper to be printed on, or upon an additional, foil-like intermediate layer in order to avoid that the roller makes marks on the paper. It is also known to provide the printer with means for breaking the sheet.

DESCRIPTION OF THE INVENTION

It is an object of the present invention to improve the known matrix printers, and to provide a printer in which the distance of the printing head from the paper is maintained with certainty whereby, in addition, the printing head has to be retracted automatically in one of its terminal positions, for example, for inserting a new sheet of paper. Moreover, the matrix printer should be reliable and its operation should be simple.

In accordance with the preferred embodiment of the present invention, it is suggested to provide flap extending alongside the printing platen and having a pivot axis which extends parallel thereto which direction is also the direction of movement of a printing head carriage on which the printing head is mounted for moving in a direction transversely thereto. The flap carries an elongated resilient sheet which extends close to the range of the printing head and adjacent to and along the printing platen. The spring biased printing head carries a roller which for a protracted position of the printing head rolls on that sheet while the spring bias causes the roller to urge the resilient sheet against the paper on the platen. The resilient sheet is fastened to the flap, particularly to a rigid portion thereof and at a side of that rigid portion facing the printing platen. In addition, the head should be provided with a second roll or roller for causing a retraction of the head, in one instance by means of a particular stationary wedge, cam, or guiding element being located in a terminal position for the carriage and engaging that second roller for shifting the head back and away from the platen. In addition, the above-mentioned flap is provided with a rigid rail, being slightly spaced from that second roller when the head is in printing position, but upon pivoting the flap, the rail thereof engages the second roller and moves the head back on the carriage regardless of the particular position of the carriage in relation to the platen except, possibly, in the terminal position.

The particular matrix printer, in accordance with the present invention, provides an automatic adjustment of the distance of the printing head from the sheet to be printed on corresponding to the thickness of the sheet even if that sheet differs in thickenss or even if plural super-imposed sheets are run over the platen. The distance is established by the roller as it engages the resilient sheet on the flap, and theother side of that resilient sheet engages the paper on the platen. Moreover, it can readily be seen that for particular situations such as changing the ink ribbon or for replacing the paper, the distance of the head from the printing platen can be considerably increased as compared with the normal distance during printing by pivoting the flap, but it is not required to recalibrate the position of the head prior to printing. Moreover, the retraction of the head on the carriage as provided is automatically established when the carriage moves into one of the end positions, whereby a funnel shape gap is formed which permits, for example, the insertion of another piece of paper.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a matrix printer having a frame for the basic support which includes two lateral frame parts 1 and 2. They are, in fact, interconnected by a cylindrical printing platen 3 and by a rod 37 on which rides a carriage 4. The assembly 1, 2, 3, and 37 establishes, in fact, a stable unit. The carriage supporting rod 37 serves additionally for guiding the carriage parallel to and along the printing platen 3. Instead of a fixed platen 3 one could use an elongated roll as a platen in which case an additional, frame completing construction part would be needed. The double arrow 7 denotes back and forth movement of the printing head carriage. The front end of carriage 4, facing the platen 3, is provided with rolls 5 which run on a rail 6.

Figure 1:
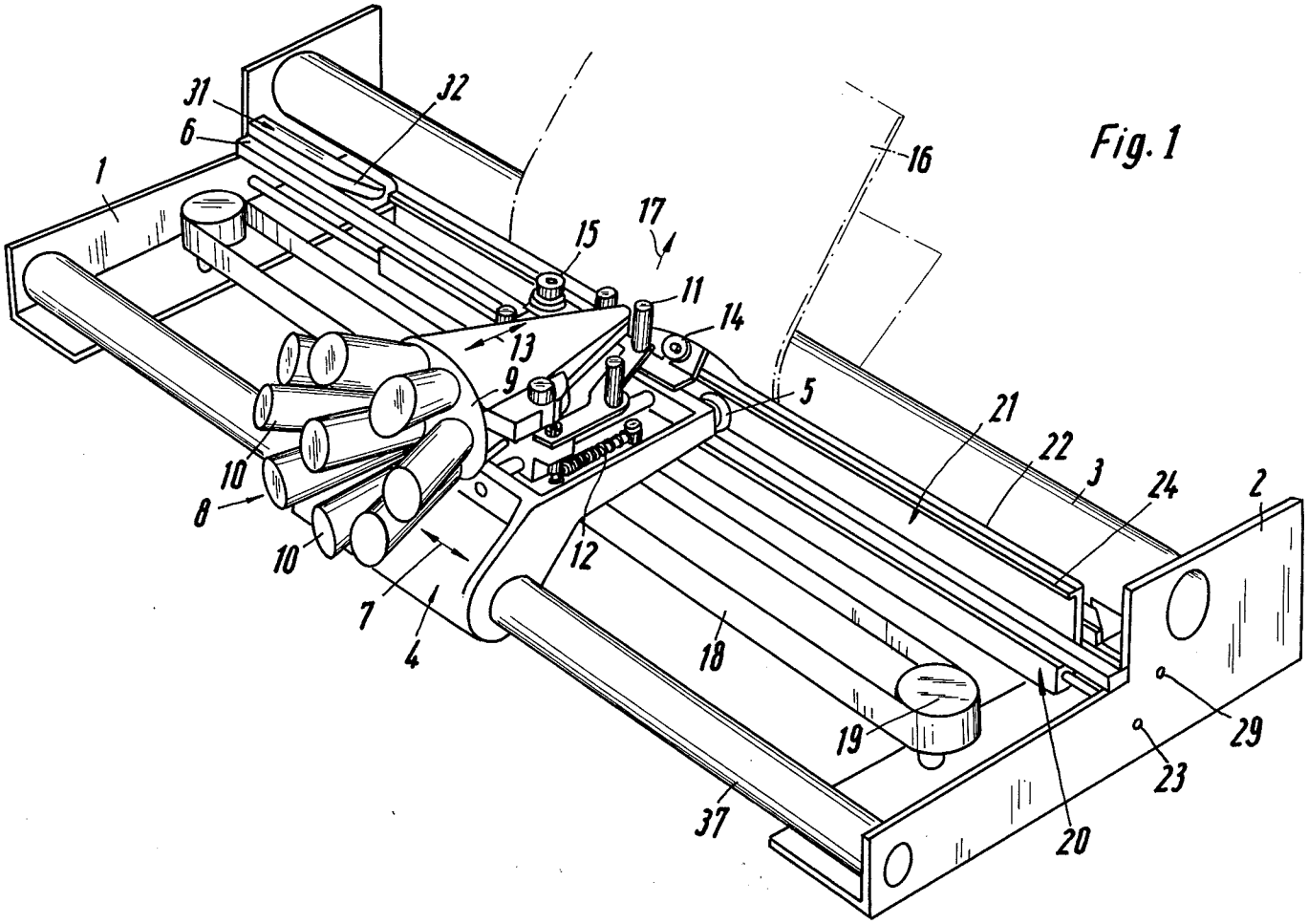
FIG. 1 illustates a portion of a matrix printer in perspective view.

A printing head 8 is mounted on carriage 4 in a manner which permits transverse movement of the head in relation to the direction of movement of the carriage. These particular directions of movability of the printing head are denoted by the double arrow 13. Printing head 8 is comprised of a casing or housing 9 containing for example nine printing needles. The front ends of these needles are vertically or staggeredly arranged adjacent the platen 3 in a manner known per se. Each of the needles is in its rear provided with an electromagnetic drive 10, and these drives are clustered and suitably arranged in the rear of housing or casing 9. The head 8 carries additionally reversing or guide posts 11 for the ink ribbon. Springs 12, only one of them being shown, are attached with one end each to both sides of the printing head 8, and anchoring posts are mounted on the carriage to which is fastened the other end of each of the springs. This way the carriage is held in a particular printing position shown in FIG. 1 as well as in FIG. 2.

The carriage 4 is driven immediately by a geared or toothed belt 18 which, in turn, is driven by a gear 19. A suitable motor, not shown, drives gear 19. FIG. 1 illustrates further an inserted sheet of paper 16 being transported during printing in the directon of arrow 17 in a manner known per se.

Figure 2:
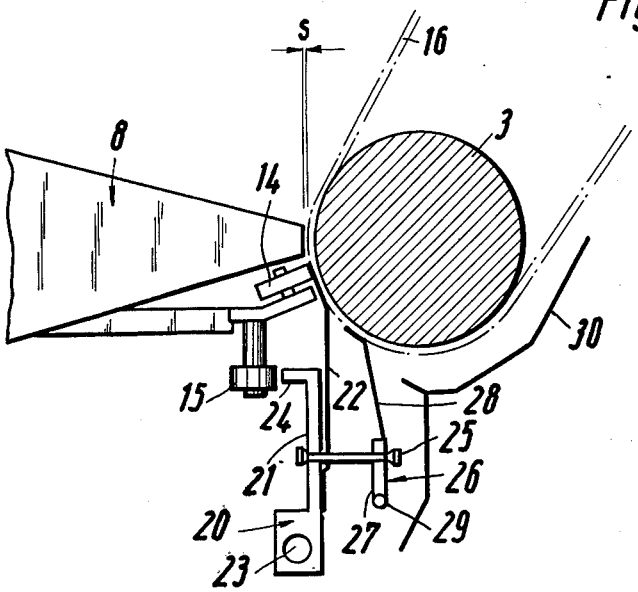
FIG. 2 is a cross-section through a portion of the printer shown in FIG. 1, showing particularly a tip of a printing head, the platen and specific features of the invention.

After having described the basic assembly of a matrix printer, the particular portions for practicing the invention are now being described with further reference to FIGS. 1 and 2. A spacer roll 14 is journalled in a suitable holder near the front end of printing head 8 but does not bear directly against the platen 3 but against an elongated, thin, resilient sheet part 22 of a two-part flap 20. The flap 20 extends basically for the length of the platen; so does sheet 22. The flap 20 can pivot about a pivot axis 23 but only for a limited amount. The long sheet 22 is secured to a rigid, flat bar portion 21 to flap 20 near its lower end, rather close to the pivot axis 23 and all along the lower edge of sheet 22. Moreoer, the sheet 22 is fastened to the rigid part 21 at the side of part 21 facing the platen 3. The sheet 22 extends up from its edge of fastening and may flex in the direction away from platen 3. However, the head 8 is biased by springs 12 into a forward position so that roller 14 engages sheet 22, flexes it toward the platen 3 so that the rear of the upper part of sheet 22 sits on the paper as wrapped around the platen. Upon movement of carriage 4, roller 14 rolls on sheet 22.

The head 8 is provided with a second roller 15 having a vertical axis of rotation. For most of the travel path of the carriage 4 roller 15 may run on a rail 24. Rail 24 is part of flap 20 and extends from and along bar 21. Near the left hand end (as seen in the view of FIG. 1) of the matrix printer frame, a cam like, stationary track element 32 is provided which , in fact, can be regarded as a continuation of the track 24.

Normally roll 15 is spaced from rail 24, particularly when the head 8 is in the printing position as shown in FIG. 2. This space, however, is significantly smaller than the pivot stroke of rail 24 upon pivoting flap 20 about axis 23.

Figure 3:
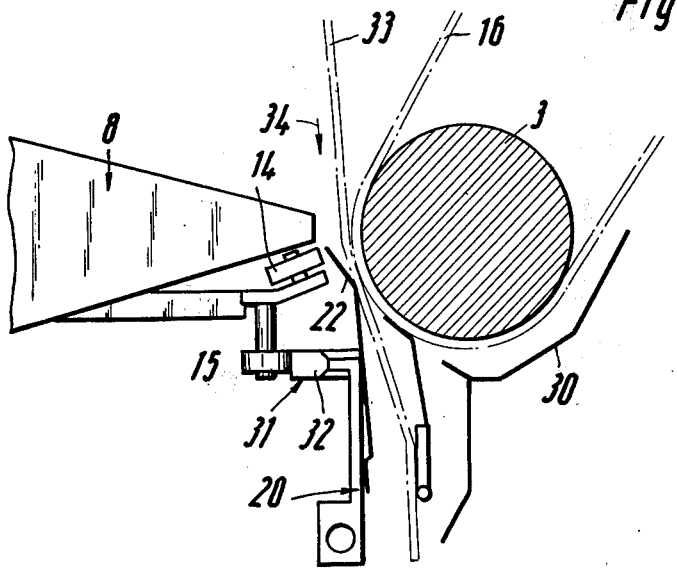
FIG. 3 is a similar cross-section showing the disposition of the printing head for insertion of an additional sheet.
Figure 4:
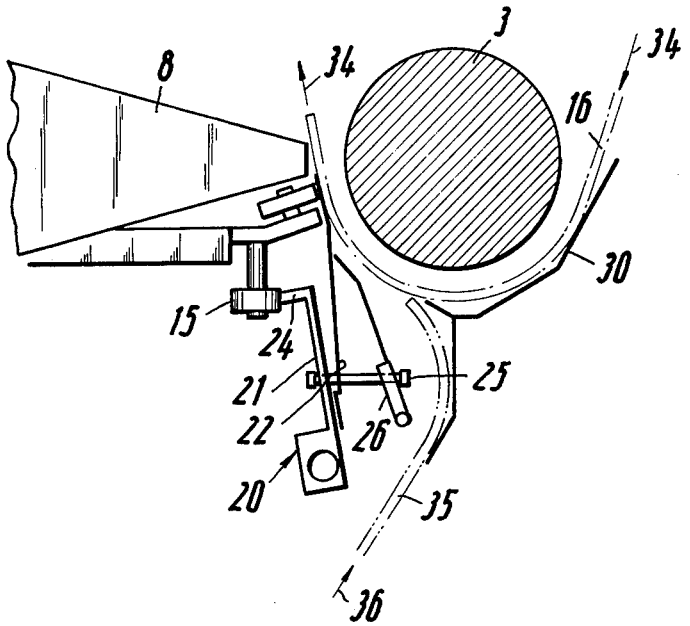
FIG. 4 is a cross-section of the matrix printer, the section plane being parallel to the one as per FIG. 2 and in a terminal position for the printer head carraige wherein the head is also in a retracted position.

As soon as flap 20 is pivoted from the position illustrated in FIG. 2 into the position illustrated in FIG. 4, rail 24 will abut roll 15 shortly after the beginning of the pivoting, and further pivoting moves head 8 back against the force of the springs 12. Moreover, the sheet 22 will recede from the platen but remains in abutment with roller 14, sheet 22 being actually flexed away from bar 21. This way a gap, funnel shaped, is produced between the also yielding resilient part 22 and platen 3 so that another sheet such as 34 or other sheets such as 36 can be inserted from above or from below. In addition, FIG. 3 shows the insertion of another sheet of paper 33 in the direction of arrow 34. Reference numeral 30 refers to parts of the housing which facilitate the threading of the sheet 16 and other.

Whenever the carriage 4 is moved into the upper terminal position as per FIG. 1, roll 15 wil contact the run-up or cam track 32 as soon as the head hs left the printing zone. Track 32 provides for cam action in that it moves the printing head transversely for retracting it from the platen 3, independently from flap 20. This action is shown in cross-section in FIG. 3 and one can readily see that cam track 32 causes the printer head to retract slightly so that again sheet 22 disengages from the paper.

The upper resilient part 22 of flap 20 is slightly bent, by a rather shallow angle in its upper third so that for retracted head 8 and when the carriage is in the range of cam track 32 as shown in FIG. 3, the axis of roll 14 and the resilient part 22 establish a triangle having an obtuse angle as formed by the bent-off top portion of resilient part 22. FIGS. 2, 3, and 4 show additionally that a long, pivotable flap 26 is provided below platen 3 for breaking the paper advance. The two flaps 20 and 26 can be pivoted in unison by means of a tension lever 25. A thin sheet resilient metal strip is mounted on breaking flap 26 for slow down and breaking of the sheet 16. This thin sheet engages the sheet 16 in a resilient manner right at the printing platen 3 to obtain the breaking function during printing.

As shown particularly in FIG. 1, the spacer roll 14 deforms resiliently the springy part 22 during printing. However, this deformation does not occur over the entire length of sheet 22 but essentially only adjacent the head 8, but in any position of carriage 4. This resilient and springy part 22 has its upper edge disposed rather close to the tip of the lowest needle in head 8 and reaches into the region through which runs the ink ribbon such that ink ribbon actually engages with its lower portion the resilient part 22. This way it is ensured that there is always a kind of wedge between the lower edge of the ink ribbon and the paper to be printed on, so that mutual contact particularly below the printing zone is avoided.

Finally, the particular separation of function of the two rolls 14 and 15 is to be mentioned, the spacer roller 14 determines the spacing proper between the tips of the printing needles and the paper, and the roll 15 determines the positioning of head 8 on carriage 4 when printing is not desired either because the carriage has moved the printing head to one of the end positions or because the head has been retracted by pivoting flap 20.

The invention is not limited to the embodiments described above but all changes and modifications thereof not constituting departures from the spirit and scope of the invention are intended to be included.

We claim:

1. In a matrix printer having a reciprocating carriage disposed for movement along a printing platen, further having a printing head mounted on the carriage for reciprocating motion towards and away from the printing platen, the combination comrising:

a first roller journalled on the head;

a pivotal flap extending for substantially the length of the platen and having a pivot axis which extends parallel to the direction of extension of the platen as well as of carriage movement, said flap having a rigid mounting bar;

a resilient support sheet mounted on said bar of said flap and extendng between the platen and the first roller, the first roller rolling on said sheet when said head is in a protracted position for printing;

a second roller journalled on the head; and means for engaging said second roller for retracting the head on the carriage.

2. In a matrix printer as in claim 1 wherein the flap has a rail serving as the means for engaging the second roller so that upon pivoting of the flap the head is also retracted on the carriage, the rail being spaced from the second roller in the protracted position of the head, the spacing being signficantly smaller than a pivot range for the flap.

3. In a matrix printer as in claim 1 wherein said means includes a cam track engaging said second roller in a terminal position of the carriage.

4. In a matrix printer as in claim 1 wherein said resilient sheet has a bent portion in its upper part, the portion being bent towards said head;

5. In a matrix printer as in claim 4 wherein in cross-section said bent portion, the remainder of the sheet, and the axis of the first roller establish a triangle with an obtuse angle established by the bent portion in the retracted position of the head.

6. In a matrix printer as in claim 1 and including a break flap movable in unison by means of a tension lever with the flap and having a resiliently mounted breaking sheet that may engage any paper on the platen.

* * * * *